US006260828B1

(12) United States Patent
English

(10) Patent No.: US 6,260,828 B1
(45) **Date of Patent: *Jul. 17, 2001**

(54) PREFABRICATED INTERLOCKING FENCE POST

(76) Inventor: Robert F. English, 939 W. Quincy St., Lakeland, FL (US) 33802

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/193,658

(22) Filed: Nov. 17, 1998

(51) Int. Cl.[7] ..... E04H 17/16; E06B 7/08

(52) U.S. Cl. ..... 256/24; 256/21; 256/25; 256/65; 256/73; 52/473; 52/588.1; 52/762; 52/775; 52/780; 52/781

(58) Field of Search ..... 256/24, 21, 25, 256/65, 73; 52/473, 588.1, 762, 775, 780, 781; 160/135

(56) References Cited

U.S. PATENT DOCUMENTS

| | | | | |
|---|---|---|---|---|
| D. 421,137 | * | 2/2000 | Marshall | D25/119 |
| 2,577,317 | * | 12/1951 | Eschrich | 52/473 |
| 2,590,929 | * | 4/1952 | Bush | 256/22 |
| 2,877,600 | * | 3/1959 | Slate | 256/24 |
| 3,136,530 | * | 6/1964 | Case | 256/24 |
| 3,199,260 | * | 8/1965 | Blok | 52/475.1 |
| 3,303,622 | | 2/1967 | Minds, Jr. . | |
| 3,304,683 | * | 2/1967 | Ferreira | 265/65 |
| 3,596,424 | * | 8/1971 | Ward | 52/520 |
| 3,606,718 | * | 9/1971 | Curran | 52/542 |
| 4,143,857 | | 3/1979 | Weiner . | |
| 4,188,019 | | 2/1980 | Meredith . | |
| 4,202,532 | | 5/1980 | Mills . | |
| 4,272,060 | * | 6/1981 | Stafford | 256/24 |
| 4,306,631 | | 12/1981 | Reusser . | |
| 4,369,953 | | 1/1983 | Greiner et al. . | |
| 4,594,829 | * | 6/1986 | Herrgord | 52/285 |
| 4,625,948 | * | 12/1986 | Lustvee | 256/22 X |
| 4,690,383 | | 9/1987 | Batcheller . | |
| 4,801,128 | * | 1/1989 | Taylor | 256/68 |
| 4,819,398 | * | 4/1989 | Dameron | 52/529 |
| 4,964,618 | * | 10/1990 | Kennedy et al. | 265/24 |
| 5,015,119 | * | 5/1991 | Schmanski | 403/13.1 X |
| 5,038,531 | * | 8/1991 | Olewska | 52/64 |
| 5,211,499 | * | 5/1993 | Zachrei | 403/258 |
| 5,404,685 | * | 4/1995 | Collins | 256/24 X |
| 5,433,047 | * | 7/1995 | Wallace et al. | 52/284 |
| 5,441,240 | | 8/1995 | Arnold . | |
| 5,480,126 | | 1/1996 | Teasdale . | |
| 5,600,971 | * | 2/1997 | Suk | 52/713 |
| 5,713,171 | * | 2/1998 | Andres | 256/65 X |
| 5,725,201 | * | 3/1998 | Parth | 256/24 |
| 5,842,545 | * | 10/1998 | Blaiotta | 52/578 |
| 6,105,314 | * | 8/2000 | Stocksieker | 52/95 |

FOREIGN PATENT DOCUMENTS

| | | | | |
|---|---|---|---|---|
| 2660003 | * | 9/1991 | (FR) | 256/24 |
| 2268524 | * | 1/1994 | (GB) | 256/24 |
| 2276180 | * | 9/1994 | (GB) | 256/73 |

* cited by examiner

*Primary Examiner*—Lynne H. Browne
*Assistant Examiner*—Ernesto Garcia
(74) *Attorney, Agent, or Firm*—Ronald E. Smith; Anton J. Hopen; Smith & Hopen, P.A.

(57) ABSTRACT

A prefabricated fence post assembly comprising a slotted fence post which slideably receives an adjoining prefabricated modular panel, picket fence, lattice or ornamental section for the construction of fences, walls and other structures incorporating panels.

3 Claims, 3 Drawing Sheets

PREFABRICATED INTERLOCKING FENCE POST

FIELD OF THE INVENTION

The present invention relates generally to fence assemblies and particularly to a prefabricated fence post assembly having one or more vertical slots which slideably accept a prefabricated fence panel without the need for traditional fasteners, providing an efficient and strong installation for privacy walls, fences and similar structures.

BACKGROUND OF THE INVENTION

Fences and privacy barriers constructed of prefabricated panels have been used for many years. Typically, such assemblies utilize a plurality of modular panels fabricated from metals, alloys or thermoplastic materials, The panels are connected to each other and to a support post using screws, nails, bolts, rivets, pins or similar fasteners or by interlocking one panel to another panel.

In a typical modular fence construction, two posts form a span between which vertically disposed panels are assembled. The panels are attached to a plurality of horizontal members spanning the two posts. The horizontal members provide rigidity and support for the panels. The panels may interlock with each other, providing additional rigidity and strength without the need for supplementary fastening devices.

However, existing interlocking systems do not extend to the post itself. Rather the interlocking panels are collectively attached to the post via the horizontal support members or with separate fasteners on the panel edge bordering the post. A disadvantage to this system is that it requires a substantial amount of time and additional hardware to assemble the structure. Furthermore, it may also require a second worker to support and stabilize the end panel while it is attached to the post.

Consequently, there is a need in the art for a prefabricated interlocking fence post system whereby the end panels slideably interlock with the post itself providing additional rigidity and forgoing the additional time and expense of using traditional fasteners to connect the panel adjoining the post.

SUMMARY OF THE INVENTION

The present invention fulfills the need in the art by providing a fence post assembly comprising a prefabricated fence post which slideably receives the edge of an adjoining modular panel within a slot ending substantially along the length of the post. A cap may be secured to the top of the post after the modular panel is slid into position. The post may comprise a plurality of slots to receive a plurality of panel edges. The post slot may also be used to receive a prefabricated lattice, picket fence or ornamental structure with edges fashioned to interlock with the post slot. An L-shaped bracket on the outside of the post slot and retainer plate placed inside the post slot may be rigidly clamped together to provide a variable-height attachment site for horizontal support rails. More particularly, the novel modular assembly for making a fence includes a first pair of upstanding, hollow post members disposed in laterally spaced apart relation to one another. Each post member of the first pair of post members has a common vertical extent and has a generally square configuration when seen in plan view. Each post member includes a front wall, a back wall, an inboard wall and an outboard wall. The respective inboard walls face one another when the novel fence is in its assembled configuration.

A vertically extending slot is formed in the inboard wall of each of the post members. Each vertically extending slot has an extent equal to an extent of the inboard wall within which it is formed so that it is in open communication with top and bottom ends of said inboard wall. Each vertically extending slot has a predetermined width.

The novel structure further includes a plurality of modular panels having a common vertical extent, said common vertical extent being less than the common vertical extent of the pair of post members. Each modular panel has a vertically extending flat front wall and a pair of vertically extending flat side walls formed integrally with the flat front wall. The flat side walls are disposed at opposite sides of the flat front wall in normal relation thereto and extend therefrom in a first common direction. The construction of each modular panel further includes a pair of vertically extending flat rear walls. Each flat rear wall is formed integrally with an associated flat side wall and is disposed normal thereto so that it is parallel to the flat front wall. The flat rear walls extend in a direction toward one another. A vertically extending flat locking wall concludes the structure of each modular panel. Each flat locking wall is formed integrally with an associated rear wall and is disposed normal thereto so that it is parallel to the side walls. Each of the flat locking walls extends in a common direction towards the flat front wall. The respective side walls, rear walls, and locking walls are hereinafter sometimes collectively referred to as the interlocking means of the modular panels. Significantly, each modular panel has a vertically extending interlocking means formed integrally with its front wall at its opposite vertical edges, and both interlocking means project in a common direction relative to said front wall. Moreover, the interlocking means have a common structure with one another so that each modular panel exhibits bilateral symmetry, thereby simplifying manufacturing of said modular panels and simplifying the assembly of the novel fence.

An upper and a lower flat retainer plate are disposed in a hollow interior of each of the fence posts in abutting relation to an interior surface of the inboard wall. Each flat retainer plate has a breadth greater than the predetermined width of the vertically extending slot.

An "L"-shaped bracket is associated with each retainer plate. Each "L"-shaped bracket has two parts disposed in normal relation to one another. Each "L"-shaped bracket is disposed external to its associated fence post and a first part thereof is disposed in abutting relation to an exterior surface of an associated inboard wall. A second part of each "L"-shaped bracket is disposed in a substantially horizontal plane, and the respective second parts extend toward one another when a fence is in its assembled configuration. The respective first parts of the "L"-shaped brackets have a breadth greater than a predetermined width of the vertically extending slot formed in each post member.

The respective inboard walls of the upstanding post members are disposed in sandwiched relation to the respective first parts of the "L"-shaped brackets and the respective flat retainer plates. A fastener means interconnects the respective first parts and the flat retainer plates. In a preferred embodiment, each fastener means is a screw and the respective first parts of the "L"-shaped brackets and retainer plates are suitably apertured to receive their associated screws. A nut may be provided for each screw or the aperture formed in each retainer plate is adapted to screw-threadingly receive its associated screw.

A second pair of hollow post members is disposed substantially horizontally so that the individual post members of said second pair are in vertically spaced apart, substantially parallel relation to one another. Each post member of the second pair of post members has a substantially common extent and has a construction in common with the post members of the first pair of post members. However, since they are horizontally disposed and respectively provide the top and bottom rails of the fence, they may best be described as rail members. The rail members are disposed with their respective horizontally extending slots in confronting relation to one another. Each rail member is supported at its opposite ends by respective second parts of the "L"-shaped brackets.

One person working alone can assemble the novel fence. A pair of post members are driven into the ground in spaced apart relation to one another so that their respective slots face toward one another. A first "L"-shaped bracket and its retainer plate are fastened to one another in sandwiching relation to a lower end of a first post member, and a second "L"-shaped bracket and its associated retainer plate are secured in the same way to the lower end of the second post member so that a horizontal rail member disposed between them will be level. The lower rail member is then secured at its opposite ends to the associated second parts of the "L"-shaped brackets; the slot formed in said rail member must be facing up. The interlocking means of a first modular panel is then slidingly introduced into the hollow interior of one of the upstanding posts from an open upper end thereof, with the front wall of said modular panel extending through the vertical slot formed in the inboard wall of said post member. The lowermost end of said first modular panel is received within the upwardly facing slot formed in the lower rail member. The interlocking means of a second modular panel is then slidingly introduced into interlocking engagement with the available interlocking means of the first modular panel and that pattern is repeated until the interlocking means of a final modular panel is slidingly received within the other post member. Since the interlocking means of each modular panel extend in a common direction from the front wall thereof, the respective front walls of contiguous modular panels will be offset from one another. The assembly is completed by securing opposite ends of the top rail member to the post members by means of suitably positioned associated retainer plates and "L"-shaped brackets. The uppermost end of each modular panel is received within the downwardly facing slot formed in the upper rail member. A suitable cap member may then be secured in surmounting relation to each post member. An advantage of the invention is that the fence assembly may be constructed using a reduced number of fasteners.

Another advantage of the invention is that by integrating the post with the adjoining panel, the fence assembly gains added strength and rigidity. Instead of tensile pressure being focused at only the locations where fasteners are affixed, the full length of the end panel and fence post brace the structure.

Another advantage of the invention is that the interlocking feature of the post design provides for easier installation of the assembly. A single worker can assemble the structure without the need for a second worker to support and stabilize portions of the structure during installation.

These and other objects, features, and advantages of the present invention may be more clearly understood and appreciated from a review of the following detailed description of the disclosed embodiments and by reference to the appended drawings and claims.

DETAILED DESCRIPTION OF THE PREFERRED EMBODIMENT

Figure 1:
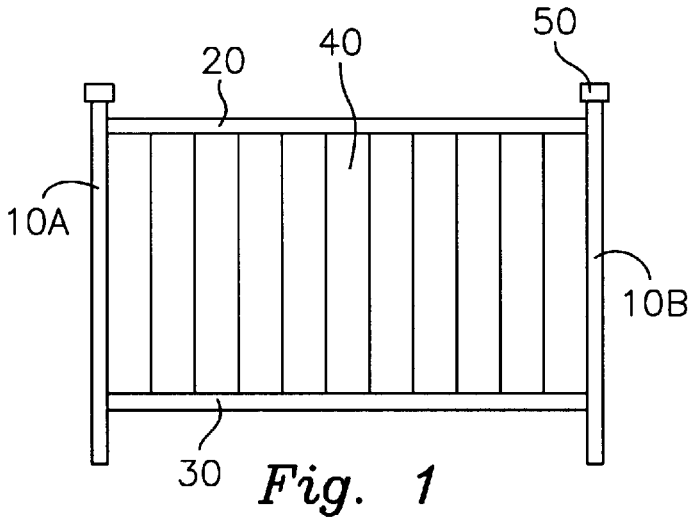
FIG. 1 is a front view of a preferred embodiment of the fence post assembly according to the invention.
Figure 2:
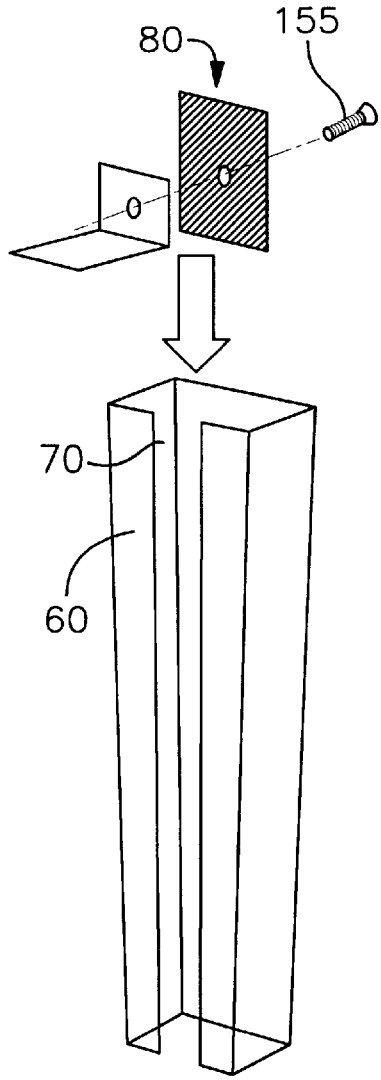
FIG. 2 is a perspective view of a preferred embodiment of the fence post and bracket assembly according to the invention.

Referring initially to FIGS. 1 and 2 of the drawings, in which like numerals indicate like elements throughout the several views, in a preferred embodiment a horizontal bottom rail 30 is secured between vertical fence posts 10A and 10B with a plurality of bracket assemblies 80. The posts have at least one slot 70 substantially the length of the post to receive one side of an interlocking modular panel 40. A plurality of the panels are received within the bottom rail 30. Successive panels may be similarly engaged with the preceding panel members to provide a post-to-post panel assembly. The individual modular panel adjoining each post is slideably received by the post and further secured by a cap 50 fitting on top of the post. A horizontal top rail 20 is secured between the posts and over the modular panels 40 using the bracket assembly 80.

Figure 3:
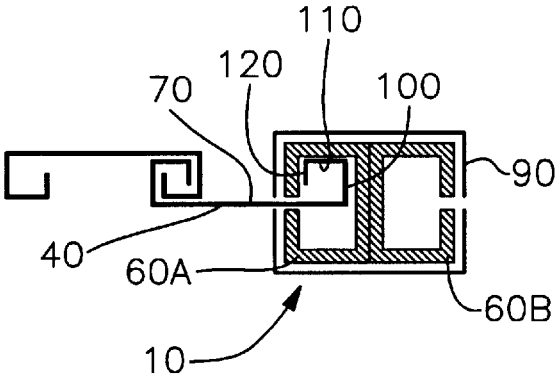
FIG. 3 is a top view of a preferred embodiment of the fence post.

FIG. 3 shows a top view of the post assembly whereby the inside of the post 10 is strengthened by one or more substantially rectangular tubes 60A and 60B of similar dimensions as the post 10. A slot in each tube extends down the length of the tube and corresponds with the slot 70 in the post 10. The tube 60 is preferably constructed of a rigid, non-corrosive metal such as galvanized or stainless steel and covered with thinner, less expensive sheet metal 90. As illustrated, the first tube 60A and the second tube 60B are rigidly fastened together to provide slot openings on opposite ends of the post 10. The modular panel 40 is slideably received by the slot 70 within the tube 60A. In a preferred embodiment, each side edge of the modular panel 40 provides a generally rectangular interlocking structure comprising a first portion 100 extending substantially perpendicular to the respective modular panel 40, a second portion 110 which extends perpendicular to the first portion 100 and substantially parallel to the modular panel 40, and a third portion 120 which extends perpendicular to the second portion 110 and substantially parallel to the first portion 100. The rectangular structures of one panel interlock with opposing rectangular structures of a second panel. The slot 70 is fashioned to slideably accept the rectangular structure, interlocking the post 10 and the adjoining panel 40.

Figure 4:
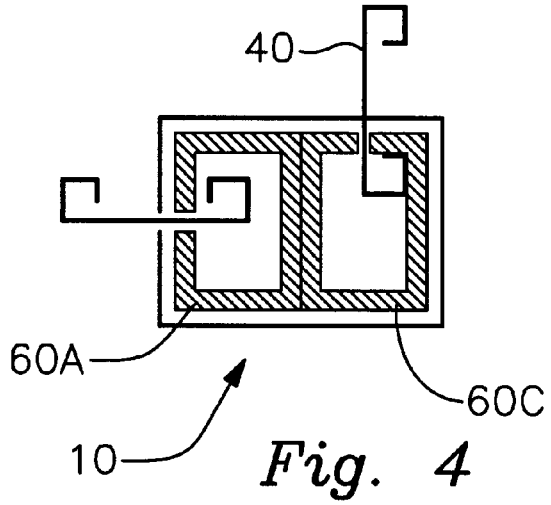
FIG. 4 is a top view of a second preferred embodiment of the fence post.

FIG. 4 shows an alternative embodiment of the fence post assembly for corner posts whereby a modified tube 60C is rotated and secured to the first tube 60A so that modular panels received by each tube are substantially perpendicular to each other.

Figure 5:
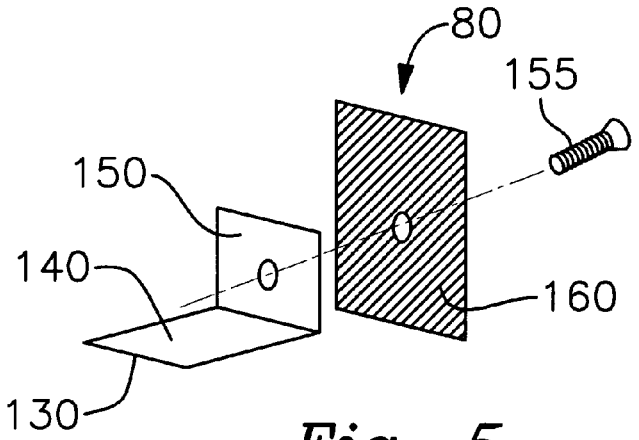
FIG. 5 is a perspective view o f the bracket assembly.
Figure 6:
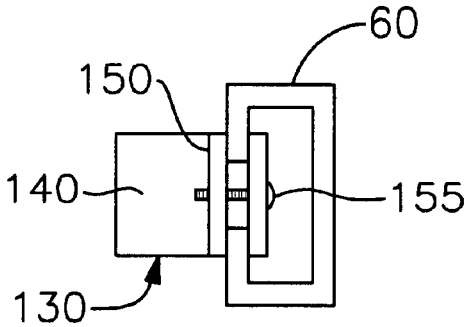
FIG. 6 is a top plan view depicting the assembly of a post, a bracket, and a retainer plate.

FIGS. 5 and 6 provide a detailed view of the bracket assembly comprising a retainer plate 160 and a L-shaped bracket 130, whereby the width of the retainer plate 160 and the L-shaped bracket 130 are greater than the width of the slot 70. The L-shaped bracket 130 comprises a vertical face 150 and a horizontal face 140. The retainer plate 160 is slideably received inside the tube 60. The L-shaped bracket 130 is positioned over the retainer plate 160 outside the tube 60. A bolt, screw, or similar fastener 155 secures the retainer plate 160 and the L-shaped bracket 130 to the post assembly. The top rail and bottom rails are secured to the horizontal face 140 of the L-shaped bracket. In a preferred embodiment, the L-shaped bracket and in the retainer plate are pierced with matching holes to receive an untightened screw which holds the L-shaped bracket and retainer plate together. The bracket assembly is able to slide up and down the post until the desired position is reached. The screw is then tightened to secure the assembly.

Figure 7A:
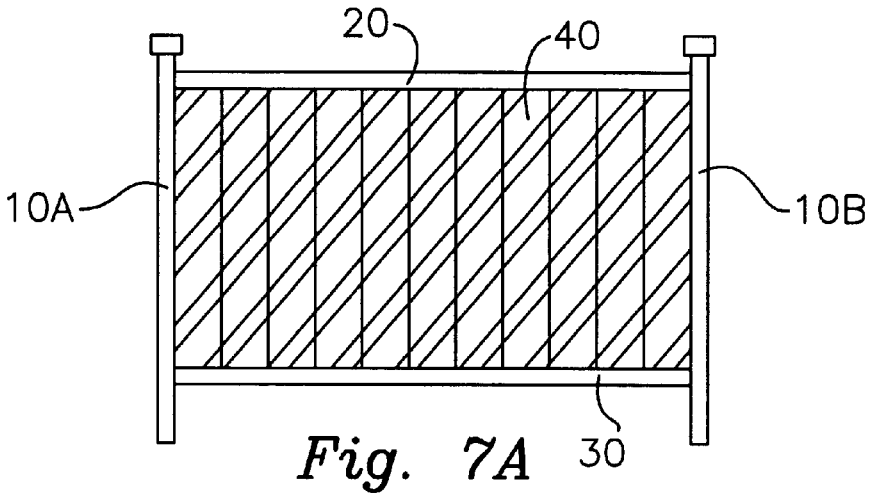
FIG. 7A is a front view of a lattice fence made in accordance with the teachings of this invention.
Figure 7B:
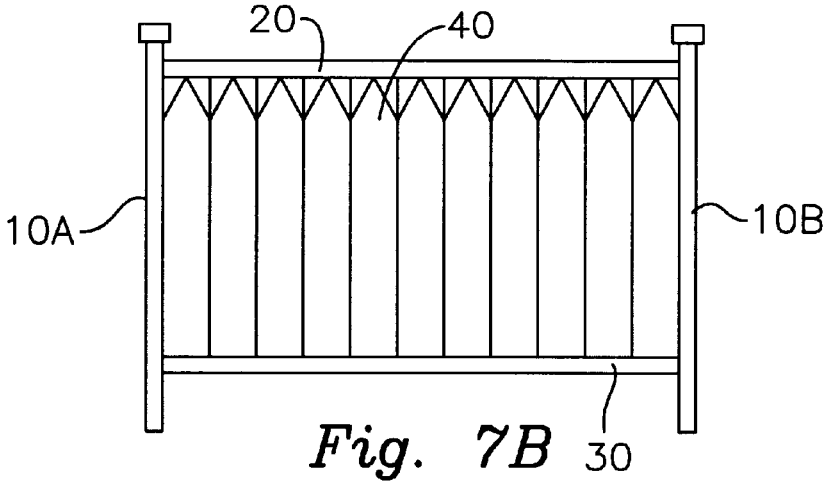
FIG. 7B is a front view of a picket fence made in accordance with the teachings of this invention.
Figure 7C:
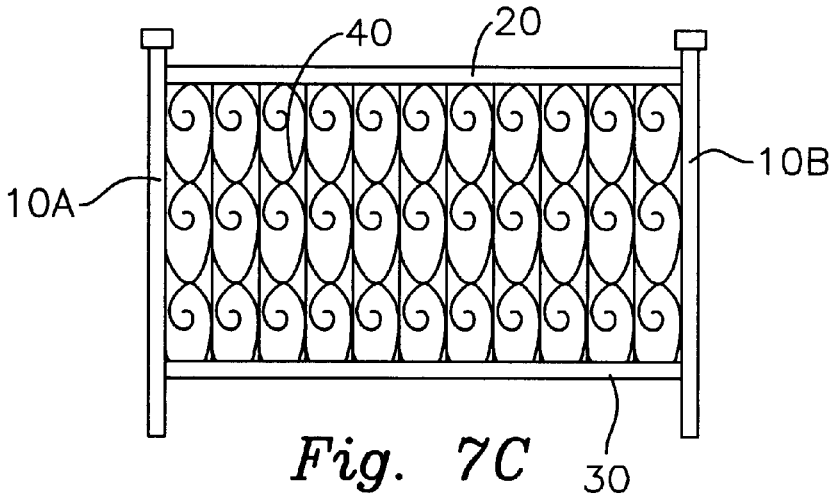
FIG. 7C is a front view of an ornamental fence made in accordance with the teachings of this invention.

FIG. 7A provides a front elevational view of a lattice fence made in accordance with the teachings of this invention. It has the same structure as the fence depicted in FIG. 1, but each panel 40 includes a plurality of equidistantly spaced apart diagonal lines, grooves, or ridges to create the lattice appearance that is depicted. FIG. 7B provides a view of a picket fence where the upper end of each panel is pointed as depicted, and FIG. 7C provides a view of an ornamental fence.

Accordingly, it will be understood that the preferred embodiment of the present invention has been disclosed by way of example and that other modifications and alterations may occur to those skilled in the art without departing from the scope and spirit of the appended claims.

What is claimed is:

1. A modular assembly for making a fence, comprising:

a pair of upstanding, hollow post members disposed in spaced apart relation to one another, said post members having a common vertical extent;

each post member having a generally square configuration when seen in plan view and including a front wall, a back wall, an inboard wall and an outboard wall;

a vertically extending slot formed in the inboard wall of each of said post members, each vertically extending slot having an extent equal to an extent of the inboard wall within which said vertically extending slot is formed so that said vertically extending slot is in open communication with top and bottom ends of said inboard wall;

each vertically extending slot having a predetermined width;

said post members disposed with their respective inboard walls in confronting relation to one another;

a plurality of modular panels having a common vertical extent, said common vertical extent of said modular panels being less than said common vertical extent of said post members;

each modular panel of said plurality of modular panels having a flat front wall, a pair of flat side walls formed integrally with said flat front wall, said flat side walls being disposed at opposite sides of said flat front wall, being disposed normal thereto and extending in a first common direction, a pair of flat rear walls, each flat rear wall being formed integrally with said flat side wall and being disposed normal thereto so that each flat rear wall is parallel to said flat front wall, each of said flat rear walls extending in a direction toward one another, and a pair of flat locking walls, each flat locking wall formed integrally with said rear wall and being disposed normal thereto so that each flat locking wall is parallel to said side walls, and each of said flat locking walls extending in a common direction toward said flat front wall;

said respective side walls, rear walls, and locking walls forming respective interlocking means, each of said interlocking means formed integrally with each modular panel at of said flat front wall opposite sides, each of said interlocking means extending relative to said front wall of said modular panel in a common direction and each of said modular panels exhibiting bilateral symmetry;

an upper and a lower flat retainer plate disposed in a hollow interior of each of said post members in abutting relation to an interior surface of said inboard wall, each of said flat retainer plates having a breadth greater than said predetermined width of said vertically extending slot;

an "L"-shaped bracket associated with each of said flat retainer plates;

each of said "L"-shaped brackets having a first part and a second part parts disposed in normal relation to one another, each "L"-shaped bracket being disposed externally to its associated post member and said first part of each "L"-shaped bracket being disposed in abutting relation to an exterior surface of an associated inboard wall, said second part of each "L"-shaped bracket being disposed in a substantially horizontal plane, said second parts extending toward one another, and said first parts of said "L"-shaped brackets having a breadth greater than said predetermined width of said vertically extending slot;

said inboard walls of said upstanding posts being disposed in sandwiched relation to said respective first parts of said "L"-shaped brackets and said respective flat retainer plates;

a fastener means for interconnecting said respective first parts and said flat retainer plates;

a pair of hollow rail members disposed substantially horizontally in spaced apart, substantially parallel relation to one another, each rail member having a substantially common extent and having a construction in common with said post members;

said rail members disposed with their respective horizontally-extending slots in confronting relation to one another;

each rail member being supported at its opposite ends by said second parts of said "L"-shaped brackets;

each modular panel of said plurality of modular panels having a top end and a bottom end respectively disposed in an associated horizontally-extending slot on said rail members;

said plurality of modular panels including a pair of end modular panels, each end modular panel having said interlocking means disposed in a hollow interior of said post member and each end modular panel having said front wall disposed in said vertically-extending slot of said post member; and each of said modular panels being disposed in interlocking relation to one another, wherein said front walls of said modular panels being offset with respect to one another.

2. The modular assembly of claim 1, wherein each of said fastener means is a screw that is loosened to permit height adjustment of said rail members and that is tightened to hold said rail members in place when said height adjustment has been accomplished.

3. The modular assembly of claim 2, wherein each of said posts comprising a tubular strengthening member formed of a non-corrosive metal covered with a layer of sheet metal.

* * * * *